US006490830B2

(12) United States Patent
Ruan

(10) Patent No.: US 6,490,830 B2
(45) Date of Patent: Dec. 10, 2002

(54) LIFE MAINTENANCE APPARATUS

(76) Inventor: Shaogang Ruan, Rm502, No.28, 99 Zhongshan Road (N.2), P.R. (CN)

( * ) Notice: Subject to any disclaimer, the term of this patent is extended or adjusted under 35 U.S.C. 154(b) by 0 days.

(21) Appl. No.: 09/757,743

(22) Filed: Jan. 10, 2001

(65) Prior Publication Data

US 2002/0124482 A1 Sep. 12, 2002

(30) Foreign Application Priority Data

Jan. 27, 2000 (CN) ..... 00216323 U

(51) Int. Cl.[7] ..... E04H 9/00; E04B 2/02
(52) U.S. Cl. ..... 52/79.1; 52/169.6; 109/91
(58) Field of Search ..... 52/79.1, 169.6; 109/15, 78, 80, 81

(56) References Cited

U.S. PATENT DOCUMENTS 3,083,979 A * 4/1963 Boyd
3,294,346 A * 12/1966 Summers
4,470,227 A * 9/1984 Bigelow, Jr.
4,490,864 A * 1/1985 Wicker, Jr.
4,631,038 A * 12/1986 Ritter
4,782,541 A * 11/1988 Tuchman
4,876,832 A * 10/1989 Wasserman
4,893,569 A * 1/1990 Hansen
5,111,543 A * 5/1992 Epshetsky
5,533,305 A * 7/1996 Bielecki
5,575,024 A * 11/1996 You
5,878,449 A * 3/1999 Belenky
5,960,592 A * 10/1999 Lilienthal
6,151,738 A * 11/2000 Arr
6,293,055 B1 * 9/2001 Watson
6,308,466 B1 * 10/2001 Moriarity

* cited by examiner

*Primary Examiner*—Carl D. Friedman
*Assistant Examiner*—Kevin McDermott
(74) *Attorney, Agent, or Firm*—Westman, Champlin & Kelly, P.A.

(57) ABSTRACT

A life maintenance apparatus to be used in case of earthquake or other disasters when users are buried in debris of a collapsed building. A six sided includes two parallel upper and bottom layers of high strength material made plates, two covering plates at front and back, and two adjustable plates on both sides.

1 Claim, 4 Drawing Sheets

LIFE MAINTENANCE APPARATUS

The present invention relates life maintenance apparatus, and more particularly relates to a type of life maintenance apparatus, which is while an earthquake is occurring.

As one of the most powerful natural disasters, earthquakes have always been a nightmare since ancient times. With the development of modern science and technology, people have made significant progress in seismic forecast and anti-seismic buildings, however, owing to the difficulty in predicting earthquakes, earthquakes still injure thousands around world every year. Sudden unexpected strong earthquake at night provides a lifetime of nightmares for those who experienced or survived the quake.

People are very fragile to the strike from collapsing buildings or even small parts of buildings. As a result they die from the first strike of such collapse. Among those who survive, some are buried deeply underneath the ruins, waiting desperately for rescue. However, rescuers often come too late owing to low efficiency in locating survivors and avoiding the use of machines. People who survive more than one week, by their own confidence to live on and with great luck to be found by rescuers, are so rare that normally they are regarded as miracles.

SUMMARY OF THE INVENTION

The present invention provides a type of life maintenance apparatus which can be used by the people who involved in the earthquake to rescue themselves.

The Life Maintenance Apparatus (LMU) according to the present invention is a six sided shell of high strength material, composed of two parallel horizontal rectangular plates, bolstered with five to nine round stands. Fixed on the front and back, there are two vertical covering plates. On two sides, there are two adjustable plates which can be, folded inside, beneath the upper layer.

The bottom layer is covered with one extra layer of cushion material such as rubber on top of which there is another manual instant inflating air cushion in the shape of an L whose extra bulge part gives extra protection to the head. Safety belt(s) combined with two handles fixed beneath the upper layer to protect user from rolling are installed in proper position as well.

Beneath the upper layer is a wireless signal transmitter which is operated by battery and can send a fixed frequency signal. Surrounding the transmitter, there are several chambers of chemicals, that when unsealed acts as an oxygen re-producer, by consuming carbon-dioxide. Also beneath the upper layer are several storage chambers for life maintenance materials, essentially water, and other items such as medicine, battery, food, mobile phone, radio etc. Opposite to the air cushion, there are 2 fixed handles.

The two folding side-plates can be pulled down in case of need, to form a complete six sides shelter.

The six sided structure of this apparatus, made from high strength material, can significantly reduce the impact from collapsing building to protect the user from being killed or hurt. When the user is buried inside the debris, the user can install the battery to the wireless signal transmitter to send it's position to the its receiver (such as rescuer) so that the latter can rapidly and accurately find the position. With the stocked material and oxygen reproducer, the user can easily stay alive for twenty days or more subject to the quantity of stock, even when in suffocating surroundings.

The help to users are both physical and psychological, as the user knows that their chance to be found is quite large, or if he could use one sort of two-way communication, the confidence to survive increases too. Storage chambers could be filled with some basic material like water and other alternatives in user's option. They could be whatever may be necessary in case of being trapped, such as medicine, compact food, blanket, mobile phone, radio, or even chess or poker card, while waiting to be rescued. Because of the shelter, rescuers, when locating the accurate position of the user, could use machines to speed up the digging process.

It is ideal to be in the form of a bed, as in sudden strong night earthquake, under a bed is probably the only possible distance a user would be able to reach in a short time. Below is the further explanation of the fulfillment of this invention in connection with the corresponding figures.

DETAILED DESCRIPTION OF THE PREFERRED EMBODIMENTS

Figure 1:
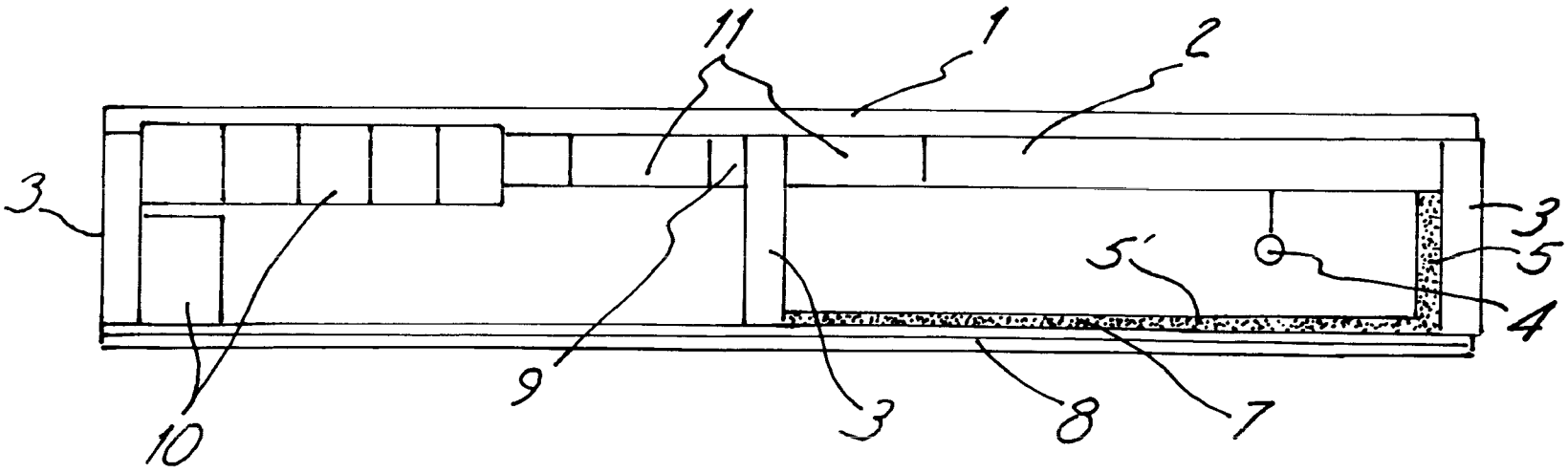
FIG. 1 is the side view of the invention.
Figure 2:
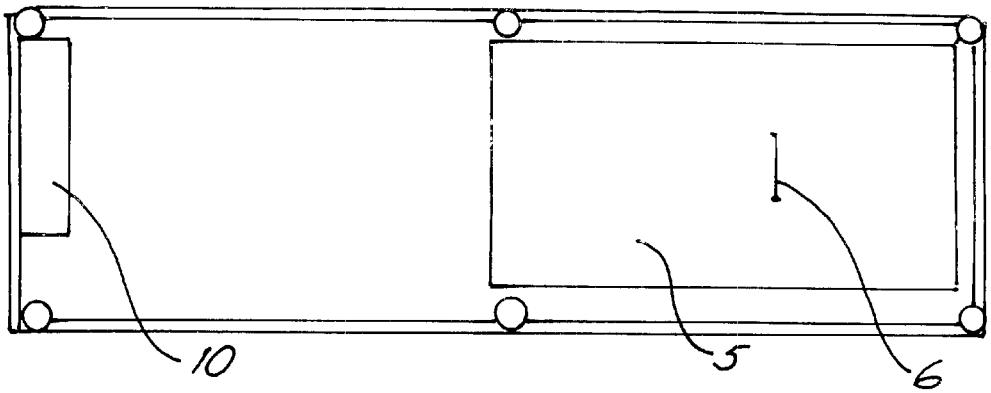
FIG. 2 is the top view of the bottom layer for a single user.
Figure 3:
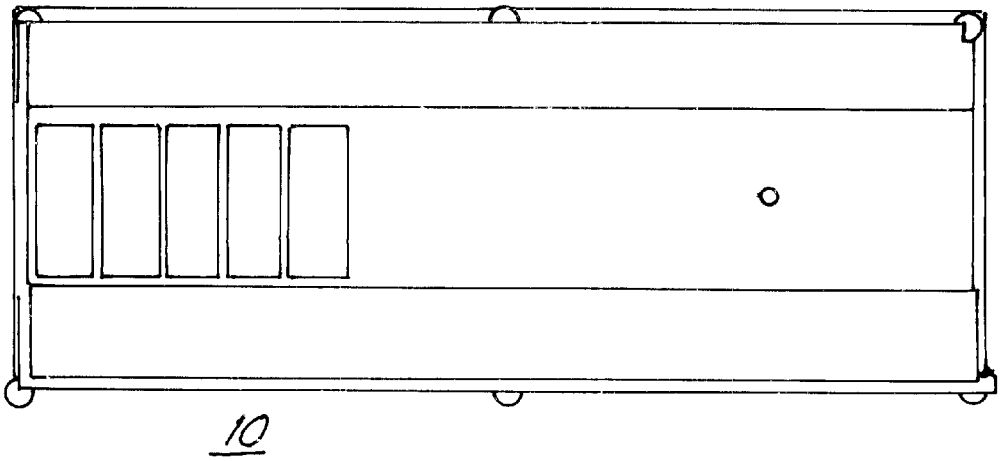
FIG. 3 is the bottom view of the upper layer for a single user.
Figure 4:
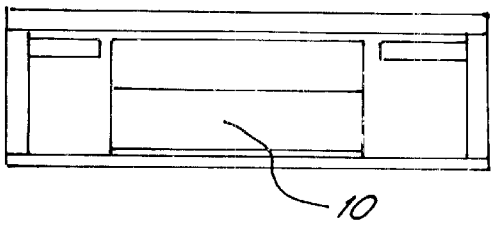
FIG. 4 is inside view of the back plate for a single user.
Figure 5:
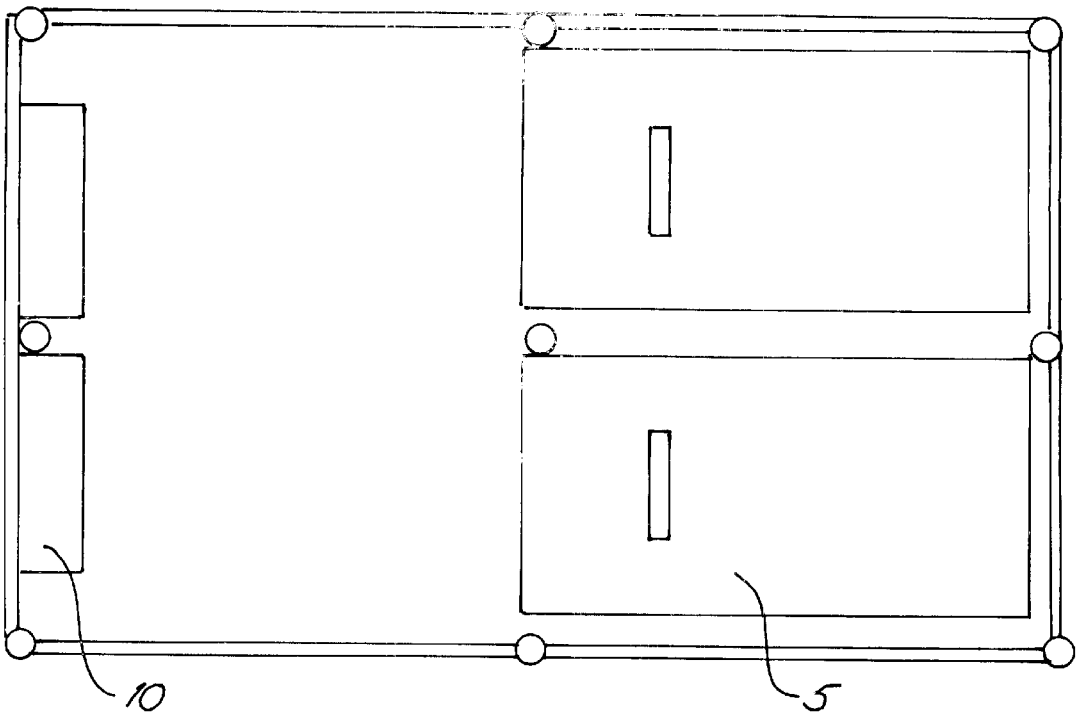
FIG. 5 is the top view of the bottom layer for two users.

As illustrated in FIG. 1, 1 is an upper layer plate, 2 are adjustable side plates, 3 are bolsters, 4 is a handle, 5' is an air cushion, 6 is a safety belt, 7 is a rubber layer, 8 is a bottom layer plate, 9 is a wireless signal transmitter, 10 are chambers of storage and 11 is an oxygen reproducer. Cushion 5' has an "L" shape as shown in the Figure and provides a bulge 5.

Figure 6:
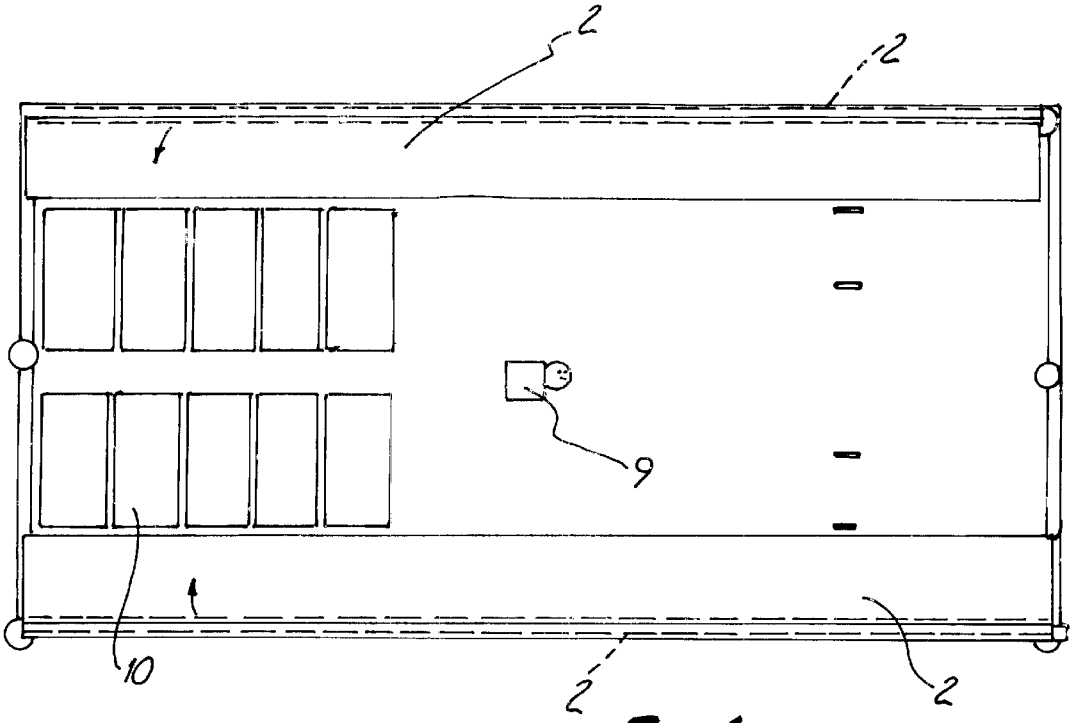
FIG. 6 is the bottom view of the upper layer for two users.
Figure 7:
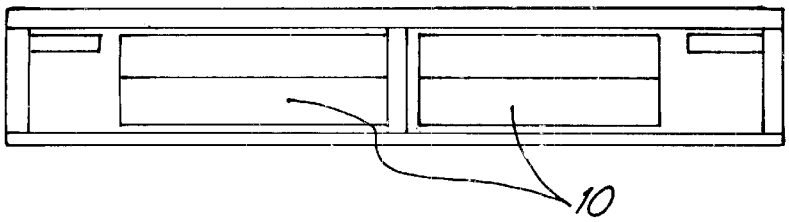
FIG. 7 is inside view of the back plate for two users.

The LMU's upper plate is made by 4 cm thick good quality steel, and the bottom layer plate 8 is made by 2 cm thick steel. They are connected with nine solid steel bolsters 3 with diameter of 7 cm. The front and back covering plates are made by 2 cm thick steel, and two sides which are configured to fold inside the LMU and beneath the upper layer plate and are connected to the edge of the upper plates. On the bottom plate 8, there is a rubber cushion 7 of 2 cm thick. On top of the rubber cushion 7, there is an L-shape air-cushion 5, using manual instant inflating, such as that used in a lifejacket on a plane, and on the air-cushion 5 is the safety belt 6 to fix the user. Opposite the air-cushion 5 on the bottom of upper layer plate 1, is balance maintaining handle 4. 9 is the wireless signal transmitter, 11 is the oxygen reproducer chamber and on back side, are chambers of storage. In FIG. 6, the dashed line shows the adjustable plates 2 in a down position and the solid line shows an up position.

The apparatus is designed for an earthquake, but it's principle of protection and life maintenance could also be applied to other similar circumstances caused by other disasters: such as tornado or war. And if the material could be heat-isolating, it could even be used in case of fire or volcano eruption.

What is claimed is:

1. A life maintenance apparatus (LMU), comprising:

a six sided shell of high strength material, composed of top and bottom parallel horizontal rectangular plates, front and back vertical covering plates, and two adjustable plates located at ends of the top and bottom plates and ends of the front and back plates;

a layer of cushion material on the interior of the bottom plate;

a manual instant inflating air cushion on top of the cushion layer which gives extra protection to an occupant's head;

a belt combined with two handles fixed beneath the top plate layer to prevent the occupant from rolling;

a wireless signal transmitter beneath the top plate operated by battery configured to send a fixed frequency signal;

a plurality of chambers of chemicals, that when unsealed act as an oxygen re-producer by consuming carbon-dioxide;

a plurality of storage chambers for life maintenance materials including water, and configured to carry medicine, battery, food, mobile phone, or radio, opposite to the air cushion; and two fixed handles;

wherein said two adjustable plates fold beneath the top plate.

* * * * *